United States Patent [19]

Kelly et al.

[11] 3,968,804

[45] July 13, 1976

[54] EXTRUDED TOBACCO SHEET

[75] Inventors: T. Kenneth Kelly, Fairfield; Donald Alfred Savitz, Stamford, both of Conn.

[73] Assignee: AMF Incorporated, White Plains, N.Y.

[22] Filed: May 20, 1974

[21] Appl. No.: 471,614

[52] U.S. Cl. ..... 131/140 C; 131/17 A

[51] Int. Cl.[2] ..... A24B 3/14

[58] Field of Search..... 264/51; 131/17 A, 140 C, 131/140 R, 17 R, 2

[56] References Cited

UNITED STATES PATENTS

| | | | |
|---|---|---|---|
| 2,778,753 | 1/1957 | Novak | 131/140 C |
| 3,251,728 | 5/1966 | Humbert et al. | 264/51 X |
| 3,379,198 | 4/1968 | Mold et al. | 131/140 C |
| 3,528,434 | 9/1970 | Halter et al. | 131/140 |
| 3,536,797 | 10/1970 | Cowan et al. | 264/51 |
| 3,613,693 | 10/1971 | Monte et al. | 131/140 |

*Primary Examiner*—Robert W. Michell
*Assistant Examiner*—Vincent Millin
*Attorney, Agent, or Firm*—George W. Price; Charles J. Worth

[57] ABSTRACT

A method and apparatus for the preparation of controlled and reduced density reconstituted tobacco materials comprising injection of inert gas into a low moisture tobacco composition maintained at an elevated temperature and paste-like consistency. Preferably, the inert gas is heated to a temperature within about 40°C of the composition prior to injection, and extruder means comprising high and low pressure zones is employed, with the point of gas injection selected to lie within the low pressure zone of the extruder or at the inlet port of a gear pump positioned after the extruder. Reconstituted tobacco materials (usually of sheet configuration) produced are characterized by even texture, uniform appearance, steady burning, and desirable taste, and can be prepared at densities lower than natural leaf.

6 Claims, No Drawings

EXTRUDED TOBACCO SHEET

BACKGROUND OF THE INVENTION

Reconstituted tobacco composition and finished products are well-known. They are commonly prepared from comminuted tobacco material which may include leaf, stem, or dust in a composition which includes an adhesive substance (sometimes a tobacco ingredient itself such as tobacco pectin) which renders the composition cohesive upon treatment. Aqueous slurries have often been employed from which cast films are prepared and thereafter dried. As this involves substantial expense for the drying step, other direction have been considered. Thus, U.S. Pat. Nos. 2,708,175 and 2,845,933 describe compositions of dry tobacco and a mucilaginous plant gum at low moisture level which are worked by a mechanical shearing action as provided by closely spaced steel rollers. U.S. Pat. No. 3,098,492 utilizes ungelatinized starch and hot extrusion. U.S. Pat. Nos. 3,166,078 and 3,209,763 employ rollers or a progressively contracting tube to accomplish sheet formation at low moisture. Ultrasonic homogenizers or disc refiners are used to process the tobacco in U.S. Pat. Nos. 3,141,462 and 3,467,109. Grunwald et al. in U.S. Pat. No. 3,424,170 uses high pressure rollers. The manufacture of reconstituted tobacco sheet products of relatively high density (0.6-0.8g/cc relative to natural tobacco leaf at about 0.4g/cc) via plastics technology was described by H. Merritt (U.S. Pat. No. 3,012,562.)

It is also known to produce reduced density tobacco compositions as by use of blowing agents, fluorinated materials, and the like. The smoking articles produced from these compositions are of value for improved filling power and, where desired, reduced delivery of smoke tars or other smoke components.

In U.S. Pat. No. 3,364,935, U.S. Pat. No. 3,404,690, U.S. Pat. No. 3,404,691 and U.S. Pat. No. 3,410,279, Moshy and Germino described inventions to produce a foamed tobacco slurry which, when cast or otherwise formed into a desired shape and suitably treated will provide a smoking article with an open cellular structure. The Moshy and Germino inventions involve processes for combining a foaming agent, a foam-stabilizing agent and tobacco, at least one element of said mixture being adhesive, creating a tobacco foam slurry from said mixture, forming said slurry into a predetermined shape and drying said shaped slurry to a preselected moisture content to produce a stable foamed product in which tobacco particles are spaced from each other by a gaseous medium. During the process of pumping and shaping the foamed tobacco slurry, the work done on this slurry can cause some degree of foam breaking and collapse. Furthermore, during the process of drying the shaped foamed tobacco slurry, further foam disruption and collapse can occur. Although the practice of the Moshy and Germino patents does result in foamed tobacco products, the inability to obtain optimum foam stabilization characteristics when using the foamstabilizing ingredients specified make the production of foamed tobacco products with exact density characteristics difficult to obtain and control. Since the uniformity of weight, firmness and draw of smoking articles produced by this process depends on control of the ultimate foam density characteristics, it is apparent to those skilled in the art that a significantly more stable foamed tobacco slurry is desired to provide the degree of foam density control during transfer, shaping and drying which is necessary for a commerically acceptable process and product.

Accordingly, it was the object of Monte in U.S. Pat. No. 3,613,693 to provide for an improved foam reconstituted product and an improved process for making same to exacting and reproducible density specifications. Nevertheless, because the process still involves the use of foamed slurries, the process is still not without disadvantages. For example, the drying rates for such slurries are extremely low compared to unfoamed slurries and they are still subject to some degree of foam collapse due to the method(s) of heat application during drying.

Based upon such background, initial experimentation with tobacco/binder systems in extruder equipment to produce controlled and reduced density reconstituted products was carried out. It was first discovered that such systems are remarkably non-homogeneous, and heavily dependent upon tobacco dimension and the presence of water to permit regular feeding through a conventional plastic extruder. Neither the presence of moisture nor the use of conventional blowing agents was successful in effecting a controlled reduction of density.

DESCRIPTION OF THE INVENTION

The present invention constitutes a method for the systematic production of controlled and reduced density reconstituted tobacco materials from comminuted tobacco, or tobacco waste or fines by means adapted to continuous, steady state operation at significant throughput. More specifically, the methods and apparatus are developed embodiments implementing the teachings of commonly assigned U.S. Pat. No. 3,012,562. It has been an objective in such development to minimize capital and manufacturing costs.

Basically, the extrusion process involves mixing a thermoplastic adhesive with tobacco particles rendering the composition formable or at least semi-molten as by disposing the resulting composition in a first enclosed zone maintained at an elevated temperature and pressure, introducing an inert gas, working said composition to effect a uniform distribution of fine bubbles therein, expressing such composition through a fine orifice to form such composition into the shape of such orifice, cooling and hardening. Typically, the generally molten mass is passed to a further (second) enclosed zone maintained at elevated temperature and pressure but a pressure reduced from that of the first such zone, and after said first zone introducing to said formable mass an inert gas under pressure. Preferably, the process is carried out in a plastic extruder sometimes coupled to a metering pump and heated nitrogen is supplied to the operation.

In the sense of manufacturing plant in-line operation, the raw tobacco is fed to a shredder which chops it into small pieces. Magnetic devices remove the tramp iron before it goes to the fine grinder which removes moisture. The thus formed powder is transported to a sifter which scalps off the coarser particles and recycles them to the grinder. The finely ground dust is screw conveyed to bins which accumulate quantities sufficient to average out variations in composition. The powder is fed to a mixer which blends a batch after which it is stored in multiple bins. The blended material is pneumatically conveyed to a mixing area, where a weight feeder meters out portions of tobacco dust and other ingredients including the thermoplastic binder or adhesive for the reconstituted tobacco product of choice, and the mixture is stored in a surge bin.

The mix is supplied to the extruder feeder, normally an auger hopper device, which feeds a jacketed extruder heating the material to the required melt temperature and ultimately extruding it through a sheeting die, and the sheet is cooled, remoistened, trimmed, cut to desired width and wound up, as on bobbins.

The tobacco employed in this invention may be of any variety customarily employed in the production of reconstituted tobacco. Excellent results have been achieved with Virginia bright scrap leaf, Wisconsin wrapper leaf, and Connecticut broadleaf. Virginia bright leaf and Virginia bright stem is also suitable although slight adjustment in composition may be desirable in this and other cases to account for the varying percentage and type of tobacco solubles present.

Tobacco waste or dust of leaf or stem may be employed directly or comminuted to an average particle size such that 100% passes through a 120 mesh screen at 5% moisture. It is understood that finer and coarser materials may be desirably present. Thus coarse dust fractions of about 20–50 mesh dimension may aid processing in certain systems. However, in all cases the particles predominate in the 80–140 mesh region. Moisture levels of the tobacco do not exceed 10% by weight and commonly fall in the 3–6% range.

The principal adhesive is a thermoplastic, normally a gum, which forms an extensible, cohesive, flexible film at high tobacco loadings. The adhesive is plastic or at least semi-molten in the region 100° to 135°C. Suitable materials include the cellulosics, such as the ester and ether derivatives and particularly the hydroxyalkyl derivatives of cellulose, as described in U.S. Pat. No. 3,278,521 incorporated herein by reference. Particularly preferred is hydroxypropyl cellulose such as Klucel H (manufactured by Hercules Inc.) of about 3.5 hydroxypropyl substitution (M.S.) and mixed ethers thereof including hydroxybutyl-hydroxypropyl, benzyl-hydroxypropyl, phenylhydroxy ethyl-hydroxypropyl and the like. Other materials which may be used are Klucel viscosity grades G, M and L, as well as cellulosics of any viscosity, grade modified to contain hydroxypropyl substituents. Also suitable are the cellulose esters such as cellulose acetate, cellulose propionate and cellulose butyrate.

Alkyl cellulose ethers such as ethylcellulose are suitable, particularly when 50% or more of the hydroxyl radicals of cellulose have been replaced by alkoxy groups. Non-cellulosic thermoplastic polymers such as olefins of the polyethylene type and polyamides of the nylon type as well as vinyl and vinylidene resins such as polyvinyl alcohol are also suitable. Waxes may also be used.

Cold extrusion performance does not appear to constitute an accurate guide to binder selection for the process of this invention. Thus, up to 70% tobacco loadings have been permissible in cold systems with Klucel K but Klucel H, preferred in the invention, shows a poor performance cold, accepting only up to 55% tobacco content before becoming too thick and dry for working.

Other ingredients may of course be employed in preparing the composition for processing, and often are preferred for selected uses. Humectants and/or plasticizers may be utilized, and might be preferred at high loadings to aid in maintaining output. Such materials as polyethylene glycol, propylene glycol, triethylene glycol and triethanolamine are representative of others in the art. Inorganic materials such as the carbonates of magnesium and calcium, or diatomaceous earth, or metallic oxides are contemplated as well as wood pulp filler. Cross-linking agents can also be employed to impart wet strength to the product, such as glyoxal, melamine-formaldehyde, urea-formaldehyde and the like. Of course, colorants, flavorants, complementing foaming agents or foam stabilizers or other additives conventional in the art may be used in the ordinary proportions. Materials constituting tobacco substitutes per se, or the ingredients therefor may be successfully used in concert with and in substitution for the tobacco. Thus, a composition prepared for extrusion might constitute tobacco together with other vegetable material in minor proportion such as wood pulp, oxidized cellulose, corn silk, etc., as well as binder such as the hydroxy alkyl or alkoxy alkyl derivatives of cellulose or starch and an inorganic material such as diatomaceous earth, with humectants or plasticizers such as triethylene glycol, with less than 10% moisture.

The target composition includes solids of at least 85% by weight at maximum tobacco content. Typically, tobacco loadings range between about 60 to 90 percent, preferably 75–85%. Binder constitutes 10 to 20% of the mixture, and up to 30% may comprise humectants, flavorants etc. As noted above, proportions of tobacco may be substituted for as other principal combustibles are used. While moisture may be present, especially where high moisture raw materials or humectants are used, the proportion does not exceed 15% by weight of the composition.

The mixed composition is fed from an auger hopper feeder to a plastics extruder defining a first enclosed zone in which barrel temperature is maintained at 120° to 180°C and pressure of 1000 to 3000 psig. The material is rendered formable and uniformly masticated by the action of the screw seated in the extruder barrel. The screw may be of any flight configuration and the screw and barrel may define a series of sub-zones adapted for feeding, transition and metering of the extrudate. A temperature profile is maintained across the barrel such that the melt temperature does not exceed 135°C preferably 110°C, to minimize loss of volatiles and to avoid tobacco charring. A preferred screw configuration constitutes a 24/1 L/D ratio and a 1:1 to 2:1 compression ratio. The screw forwards the tobacco composition to the outlet which is integral with the inlet to a second enclosed zone maintained at a lower pressure than the first zone, comprising means adapted to forward constant mass at constant rate to the outlet die. A metering gear head pump is suitable. Intermediate said first and second zones or at least following let down of pressure, an inert gas is injected under pressure into the formable composition. It is understood that the pressure of the inert gas and that maintained in the second zone from and after the injection point is less than that sufficient to cause blow back into the first zone and is selected to lie in the range 500 to 2500 psig. The inert gas pressure is of course no less than the applicable pressure at the point of addition.

Preferably, the entire process is carried out in a plastics extruder such as those supplied by Brabender; Killion; Waldron Hartig; and Reifenhauser. Twin screw extruders have been successfully employed. The gas may be sparged directly from internally of the extruder screw by positioning of suitable inlets intermediate of the extruder length.

In a preferred embodiment, the inert gas is heated to within 20°–60°C of the melt temperature at the point of addition. Commonly, melt temperature is about 80°–135°C and gas is introduced at about 50°–115°C under pressure of 400–2000 psig from the gas cylinder. Any otherwise suitable inert gas may be employed such as carbon dioxide, air or freon, but nitrogen is most readily available and serves adequately. At a material flow rate of 35 g/min. through a ¾ inch plastics extruder, a gas flow of 13,000 cc/min. at 500 psig. has been found adequate. Generally, 100 to 2000 volume ratio of gas is supplied to the tobacco composition.

The head pump or second zone acts to maintain a steady, uninterrupted flow of hot material to prevent scorching of the hot tobacco and to maintain a uniform dispersion of fine gas bubbles within and throughout the extrudate. The outlet die may constitute a single sheeting or ribbon die or may comprise a series of orifices of any dimension through which the tobacco composition is expressed. Filaments are desired where cigarette filler shred is being prepared, (multiple ends are twined and shredded) and multilobal, e.g., star or fluted cross-sections are well suited. In one embodiment an array of eight 0.013 inch circular orifices is used, in another a 20 mil sheeting die, and when cigarette rod is being extruded directly, a pipe die may be utilized.

It is possible in the practice of this invention to achieve significant material throughput. Thus, it has proven possible to run continuously at about 400 lbs/hr. with a sheet weight of 5–6 g/ft$^2$ at product speeds of 230–350 fpm. The high speed operation idicates the prospect of coupling this line directly to a cigarette making machine without intermediate windup.

The extrudate may in some embodiments be subjected to drawdown of up to 100% before tensile stress effects breakdown in structural cohesiveness, and such practices may be preferred where it is desired to provide a fibrillar film structure or induce a certain degree of tensile strength.

The reconstituted products are characterized by even texture, uniform appearance, steady burning and desirable taste. In film, foil, rod or filament form, they exhibit a density of less than 0.35g/cc to as little as 0.1 to 0.2g/cc and comprise tobacco particles in a coherent structure adhered by the thermoplastic binder including uniformly spaced interstitial voids of relatively uniform dimension in the range of between about 25 and about 100 microns as determined by microscopy.

The following Examples illustrate the invention in accordance with the best mode known to the applicants. All parts are by weight. The tests and methods referred to are those commonly employed in this art.

EXAMPLE I

A dry blend is made of 20 parts of hydroxypropyl cellulose (Klucela H, Hercules Inc.) at 3% moisture (about 3.5 M.S. hydroxypropyl substitution and particle size of 100% through 120 mesh screen) and 80 parts of bright tobacco dust (100% through 120 mesh screen) at 5% moisture. The mix is heated in a ¾ inch Brabender extruder with barrel temperature of 135°C and melt temperature of 110°C for extrudate. Hot nitrogen gas (80°C) is introduced under pressure (1800 psig) from a gas cylinder through an injection port between the end of the extruder and the inlet of the head pump. The hot mixture was extruded at a flow rate of 35 grams/min. and a gas flow rate of 13,000 cc/min. The hot, foamed mixture was passed through a sheeting die to obtain one inch wide sheets, 21 mils thick at a density of 0.16 g/cc at 3% moisture. The sheet on cooling was shredded and made into cigarettes.

EXAMPLE II

A dry blend is made of 40 lbs. of Klucel (as in Example I) at 3% moisture and finely ground to 100% through 120 mesh screen, and 320 lbs. of Wisconsin wrapper tobacco at 5% moisture and finely ground to 100% through 120 mesh screen. The mix is fed with an auger feeder in the hopper of the extruder and is then heated and gassed in a Waldron-Hartig 4 ½ inch extruder with screw having 20/1 L/D and 1/1 compression ratio. Barrel temperatures were maintained at 95°C in feed zone and 130°C in the metering compression zones. Unheated $CO_2$ gas from a cylinder is metered to the vent port in the middle of the barrel length and admixed under 800 psig barrel pressure and 2000 psig (gas) cylinder pressure. The hot extrudate passed through a sheeting die, heated to 120°C and at a back pressure of 1200 psig. The molten sheet, 8 mils thick and at 0.1 g/cc (density) was passed over a cooling drum and then was wound up into mill rolls. The extruder output was 400 lbs/hr. at a screw speed of 75 rpm.

EXAMPLE III

In a manner similar to that described in Example I, a ¾ inch Brabender extruder (L/D 20/I; compression ratio 2/1) coupled to a Zenith pump equipped with a 20 mil sheet die was employed. 80 parts of Virginia bright scrapleaf at 6% moisture was blended with Klucel H hydroxypropyl cellulose at 3% moisture, both ingredients having been ground and sifted, 100% through 120 mesh.

The blend was metered to the extruder hopper at a rate of 36 g/min (Gary feeder setting 48) and advanced at an extruder speed of 110 rpm and an average torque of 950 meter-grams under a pressure of 1900 psig through zones maintained at temperatures, respectively of 135°C, 138°C and 132°C. whereupon the molten blend was forwarded to a Zenith metering pump.

Nitrogen at a temperature of 93°C under cylinder pressure of 1800 psig and a flow rate of 13,000 cc/min. was supplied to the inlet side of the Zenith pump operating at 170 rpm and 132°C, feeding melt to the sheet die maintained at 118°C. Melt temperature measured 121°C.

The resulting sheet was of uniform appearance and exhibited a density of 0.16 g/cc., with a moisture level of 3.0%.

EXAMPLE IV

Cigarette rod of 0.23 g/cc was prepared in the same manner as described in Example III, utilizing VBSL tobacco of 5.5% moisture level. The tobacco/Klucel blend was fed (Gary feeder setting 90) to the Brabender extruder operated at 1300 psig and an average torque of 900 meter grams, and forwarded through zones maintained at 141°C, 147°C and 132°C respectively to the entry of the Zenith pump, at which point nitrogen gas was injected. The melt containing nitrogen gas was then advanced through the head pump at 170 rpm and a temperature of 132°C to a cigarette die nozzle, maintained at 93°C. Melt temperature measured 132°C. Rod moisture level was 8.2%.

We claim:

1. A process for the preparation of reconstituted tobacco materials which comprises forming a composition consisting essentially of tobacco particles, a thermoplastic binder, and less than 15% moisture;

maintaining said composition in an enclosed atmosphere under a pressure of between about 1000 and about 3000 psig and an elevated temperature, sufficient to render the composition plastic, of between about 100°C. and about 150°C.;

injecting an inert gas into said composition, wherein the inert gas in injected at a temperature within 20°C. and 60°C. of the temperature of said composition;

working said composition to effect a uniform distribution of fine bubbles therein;

expressing said composition through an orifice to form said composition into the shape of such orifice; and cooling.

2. The process of claim 1, wherein the plastic composition comprises as principal binder hydroxypropyl cellulose.

3. The process of claim 1, wherein the ratio of tobacco to binder is from about 3:1 to about 9:1.

4. The process of claim 1, wherein the enclosed atmosphere is maintained throughout two zones through which the composition is passed sequentially, the pressure of the second of said zones is less than that of said first zone and said inert gas is injected at a point following pressure let down between the zones.

5. In a process for the preparation of reconstituted tobacco materials by hot extrustion of a composition consisting essentially of tobacco particles and a thermoplastic binder, the improvement which comprises providing a first and second enclosed zone for extrusion under heat and pressure, the second of said zones being maintained at a lower pressure than the first of said zones and introducing to said composition after said first zone an inert gas maintained at a temperature within 40°C of the composition temperature at the point of addition.

6. The process of claim 1 wherein said inert gas is supplied at a rate to provide to said composition from about 100 to 2000 volume ratio of said inert gas.

* * * * *